US006461016B1

(12) United States Patent
Jamison et al.

(10) Patent No.: US 6,461,016 B1
(45) Date of Patent: Oct. 8, 2002

(54) ADJUSTABLE RECESSED DOWNLIGHT

(75) Inventors: William H. Jamison, Covington; Stephen M. Stafford, Radford, both of VA (US); Daniel R. Kennedy, Omaha, NE (US)

(73) Assignee: Hubbell Incorporated, Orange, CT (US)

( * ) Notice: Subject to any disclaimer, the term of this patent is extended or adjusted under 35 U.S.C. 154(b) by 36 days.

(21) Appl. No.: 09/695,428

(22) Filed: Oct. 25, 2000

(51) Int. Cl.[7] ..... F21V 21/02
(52) U.S. Cl. ..... 362/147; 362/226; 362/365
(58) Field of Search ..... 362/226, 147, 362/148, 150, 365

(56) References Cited

U.S. PATENT DOCUMENTS

| | | | | |
|---|---|---|---|---|
| 1,982,957 | A | | 12/1934 | Knell |
| 2,023,083 | A | | 12/1935 | Knell |
| 2,140,861 | A | | 12/1938 | Steketee |
| 2,233,334 | A | | 2/1941 | Austin, Jr. |
| 2,260,829 | A | | 10/1941 | Carlson |
| 2,269,228 | A | | 1/1942 | Rugg |
| 2,316,389 | A | | 4/1943 | Atkinson |
| 2,528,418 | A | | 10/1950 | Buckels |
| 2,670,919 | A | | 3/1954 | Esoldi |
| 2,713,983 | A | | 7/1955 | Kay |
| 2,729,414 | A | | 1/1956 | Clark |
| 2,788,188 | A | | 4/1957 | Smith et al. |
| 2,824,167 | A | | 2/1958 | Bauer |
| 2,917,263 | A | | 12/1959 | Appleton et al. |
| 2,925,236 | A | | 2/1960 | Cook et al. |
| 2,933,549 | A | | 4/1960 | Antonucci |
| 2,945,661 | A | | 7/1960 | Appleton |
| 3,104,087 | A | | 9/1963 | Budnick et al. |
| 3,518,421 | A | | 6/1970 | Cogdill |
| 4,039,135 | A | | 8/1977 | Schenk |
| 4,050,603 | A | | 9/1977 | Harris et al. |
| 4,336,575 | A | | 6/1982 | Gilman |
| 4,361,992 | A | * | 12/1982 | Rapp ..... 362/148 |
| 4,408,262 | A | * | 10/1983 | Kusmer ..... 362/147 |
| 4,717,099 | A | | 1/1988 | Hubbard |
| 4,909,405 | A | | 3/1990 | Kerr, Jr. |
| 5,222,800 | A | | 6/1993 | Chan et al. |
| 5,303,894 | A | | 4/1994 | Deschamps et al. |
| 5,440,471 | A | | 8/1995 | Zadeh |
| 5,505,419 | A | | 4/1996 | Gabrius |
| 5,588,737 | A | * | 12/1996 | Kusmer ..... 362/148 |
| 5,672,003 | A | | 9/1997 | Shemitz et al. |
| 5,678,799 | A | | 10/1997 | Jorgensen et al. |
| 5,803,585 | A | | 9/1998 | Littman et al. |
| 5,823,664 | A | | 10/1998 | Demshki, Jr. et al. |
| 5,857,766 | A | | 1/1999 | Sieczkowski |
| 5,954,304 | A | | 9/1999 | Jorgensen |
| 5,957,574 | A | | 9/1999 | Hentz et al. |
| 6,036,337 | A | | 3/2000 | Belfer |

* cited by examiner

*Primary Examiner*—Laura K. Tso
(74) *Attorney, Agent, or Firm*—Tara L. Hoffman; Alfred N. Goodman

(57) ABSTRACT

A recessed downlight for installation between joists located in a ceiling, comprising a socket box assembly and a hanger bar assembly that both adjust to the size of the space between the joists and various obstacles therein. The socket box assembly includes a housing having a socket enclosed therein providing an electrical connection for a lamp. The socket box housing is slidably coupled to the hanger bar assembly, thereby allowing the housing to be moved to a desired location along the length of the hanger bar assembly. Hanger bar assembly includes telescoping hanger bars and adjustable vertical legs. In addition, the vertical legs rotate with respect to the hanger bars, thereby allowing the installer to mount the downlight diagonally between joists. A trim and a can for the downlight are releasably attached to the socket box assembly without the use of tools, thereby allowing the installer to easily remove and/or replace the trim or can.

43 Claims, 11 Drawing Sheets

ADJUSTABLE RECESSED DOWNLIGHT

FIELD OF THE INVENTION

The present invention generally relates to a recessed downlight constructed to facilitate installation by adjusting to the spacing and various obstacles located in the installation or mounting area for the light. Specifically, the recessed downlight includes an adjustable hanger bar assembly, adjustable vertical legs, and an adjustable socket box having a socket electrically connected to the lamp and junction box.

BACKGROUND OF THE INVENTION

Recessed lighting fixtures or downlights provide lighting for a space, such as a building or room, and are aesthetically pleasing since the fixtures are advantageously recessed in the ceiling. Typically, these recessed downlights vary in structure depending on whether they are installed in new construction or in existing ceilings. Conventional downlights include a socket assembly electrically connected to a lamp, a sensor for detection of overheating, a trim, and a mounting plate attached to hanger bars for mounting the light to a pair of joists in a ceiling or a suspended T-bar ceiling.

Conventional downlights are typically difficult to install because they do not readily adjust to the installation area in more than one direction. In particular, the mounting assemblies of conventional downlights do not easily adjust to the width of the installation area. In addition, conventional downlights cannot easily adjust horizontally within the installation space to accommodate a desired ceiling location. Moreover, the conventional downlights do not provide a mechanism for avoiding various obstacles that may be present in the installation area, such as electrical conduit or plumbing. Furthermore, the prior art downlights do not vertically adjust to joists which may varying in size.

Also, the installation of the conventional downlights is difficult and cumbersome since the mounting assemblies require a mounting plate for supporting the downlight and at least four hanger bars, each attached to a joist or suspended T-bar ceilings, for supporting the plate. Moreover, once mounted, the conventional downlights require the use of various tools and fasteners to attach the trim and can for IC applications. In addition, the location of the thermal sensor of the conventional downlight can also obstruct removal and mounting of the trim and/or can. As a result of this, the trims and cans of the conventional downlights cannot be easily removed or replaced. In addition, prior art downlights do not provide a mechanism for independently attaching various sized trims and cans.

Other problems with conventional downlights are that they do not typically accommodate retro-fit applications where the downlight must be installed through a preexisting ceiling aperture and where portions of preexisting downlights may still remain in the installation area.

Examples of prior art downlights are disclosed in U.S. Pat. No. 5,440,471 to Zadeh; U.S. Pat. No. 5,823,664 to Demshki, Jr. et al.; U.S. Pat. No. 5,857,766 to Sieczkowski; U.S. Pat. No. 5,957,574 to Hentz et al.; and U.S. Pat. No. 6,036,337 to Belfer.

SUMMARY OF THE INVENTION

Accordingly, an object of the present invention is to provide a recessed downlight that is adjustable, thereby facilitating installation of the light.

Another object of the present invention is to provide a recessed downlight having an adjustable hanger bar assembly and socket box whereby the socket box can slide and adjust to the installation area and various obstacles therein.

A further object of the present invention is to provide a recessed downlight having adjustable vertical legs, thereby accommodating various sized support structures or joists.

Another object of the present invention is to provide a recessed downlight having rotatably movable vertical legs, thereby facilitating mounting of the light in smaller installation area.

Yet another object of the present invention is to provide a recessed downlight requiring only two mounting points.

Another object of the present invention is to provide a recessed downlight having a trim that is easily connected and removed from the light without the use of tools.

Still another object of the present invention is to provide a recessed downlight having a can that is easily connected and removed from the light without the use of tools.

A further object of the present invention is to provide a recessed downlight that accommodates various sized trims and cans independently of one another.

Another object of the present invention is to provide a recessed downlight that includes a barrier mechanism that protects the wires of the socket from the mounting assembly of the light.

Still yet another object of the present invention is to provide a recessed downlight that can be easily employed in retro-fit applications.

The foregoing objects are basically attained by a lighting fixture, comprising a housing having an inner area for holding a socket assembly, and including an engagement surface; and a first support member coupled to the housing, and having a longitudinal axis, and first and second sections, the first section having a sliding surface for engaging the housing, the second section having a first securing surface for engaging a first support structure, and the sliding surface of the first section directly engaging the engagement surface of the housing thereby supporting the housing on the first support member and allowing the housing to slidably traverse the first support member along the longitudinal axis.

The foregoing objects are also basically attained by a lighting fixture, comprising a housing having an inner area for holding a socket assembly, and including an engagement surface; and a first support member slidably coupled to the housing, and having a first section, and a second section substantially perpendicular to the first section, the first section having a sliding surface for engaging the engagement surface of the housing, and the second section having first and second segments, each of the first and second segments including first and second securing surfaces defined along a vertical axis, respectively, for adjustably securing the first support member to a first support structure with respect to the vertical axis.

The foregoing objects are also basically attained by a lighting fixture, comprising a housing having an inner area for holding a socket assembly; and a first support member coupled to the housing, and having a first section and a second section, the second section having a securing surface engaging a first support structure thereby defining a first horizontal angle and a first vertical angle between the first section of the first support member and the first support structure, the first horizontal angle being either one of an obtuse angle and an acute angle, and the first vertical angle being substantially ninety degrees.

By structuring the lighting fixture in this manner, installation of the light is facilitated since the light fixture can be adjusted to any sized installation area, disposed in any desired location and can avoid various obstacles that may be present therein.

Other objects, advantages and salient features of the invention will become apparent from the following detailed description which taken in conjunction with annexed drawings, discloses the preferred embodiments of the present invention.

BRIEF DESCRIPTION OF THE DRAWINGS

Referring to the drawings which form a part of this disclosure.

DETAILED DESCRIPTION OF THE INVENTION

Figure 1:
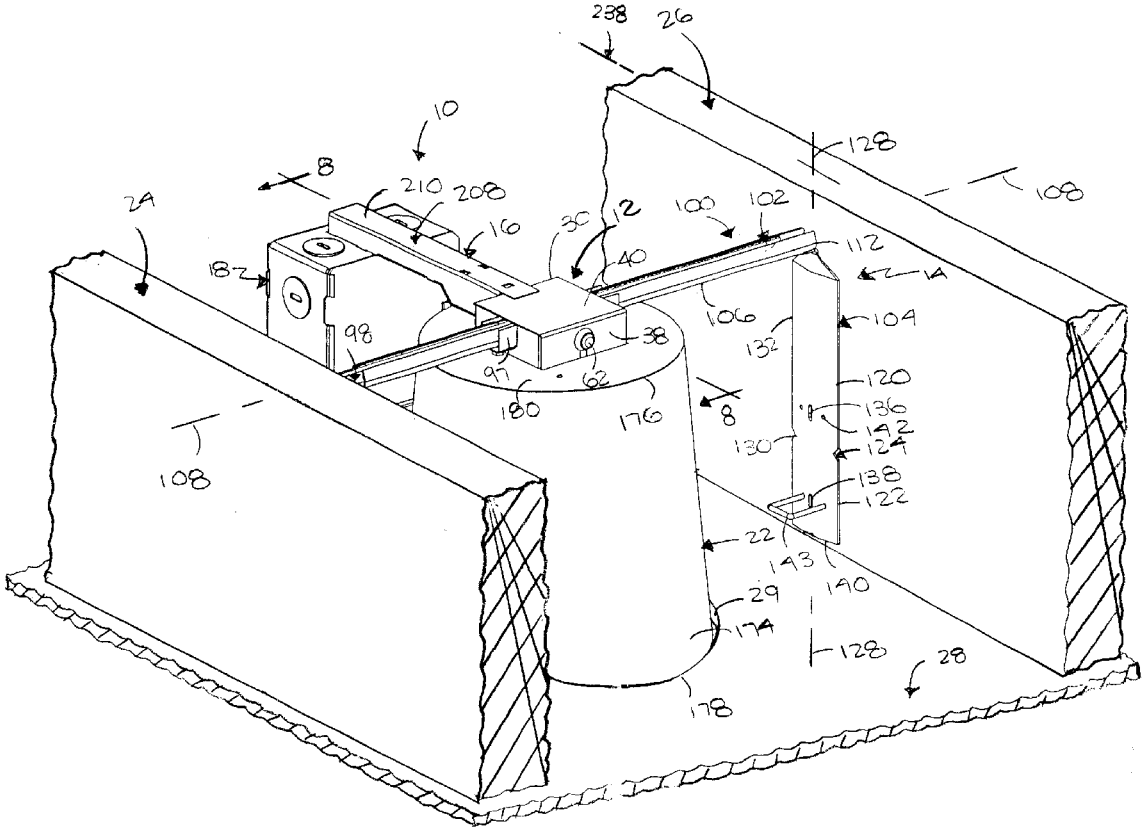
FIG. 1 is a perspective view in elevation of a recessed downlight according to a first embodiment of the present invention, illustrating a hanger bar assembly mounted to a pair of joists, a socket assembly with a wireway and a junction box attached thereto, and a can housing enclosing said socket assembly.
Figure 2:
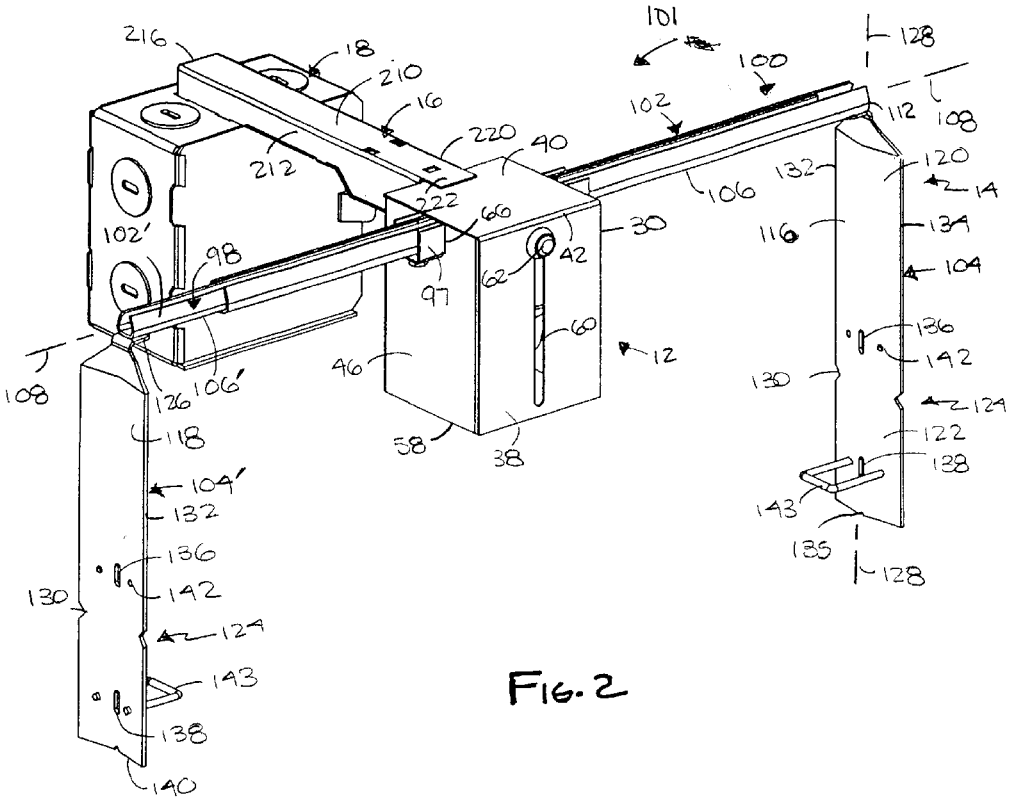
FIG. 2 is a perspective view in elevation of the recessed downlight illustrated in FIG. 1, showing the hanger bar assembly, and the socket assembly with the wireway and the junction box attached thereto.
Figure 3:
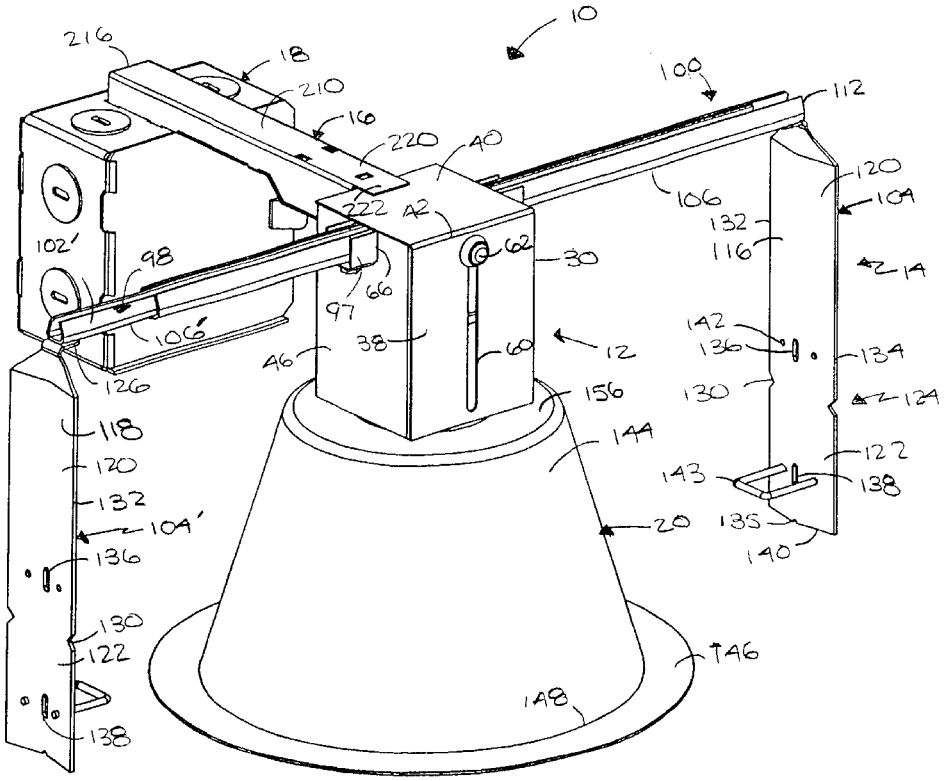
FIG. 3 is a perspective view in elevation of the recessed downlight illustrated in FIG. 1, showing the hanger bar assembly, the socket assembly with the wireway, the junction box, and a trim attached thereto.

Referring to FIGS. 1–15, a recessed downlight 10 according to a first embodiment of the present invention generally includes a socket box assembly 12 slidably mounted to a hanger bar assembly 14 with a wireway 16 and a junction box 18 connected to socket box assembly 12. A trim 20 and optionally a can housing 22 are releasably attached to socket box assembly 12, as seen in FIGS. 1–3. Recessed downlight 10 is mounted between a pair of joists 24 and 26 via hanger bar assembly 14 and above a conventional ceiling 28 such as wallboard or tiles. Trim 20 rests within an aperture 29 in ceiling 28. The components of downlight 10 are preferably formed of metal.

Socket box assembly 12 includes a housing 30 having an inner area 32 that retains a socket assembly comprising a socket 34 and a socket bracket 36 that supports socket 34 within housing 30 where socket 34 is electrically connected to junction box 18.

Figure 4:
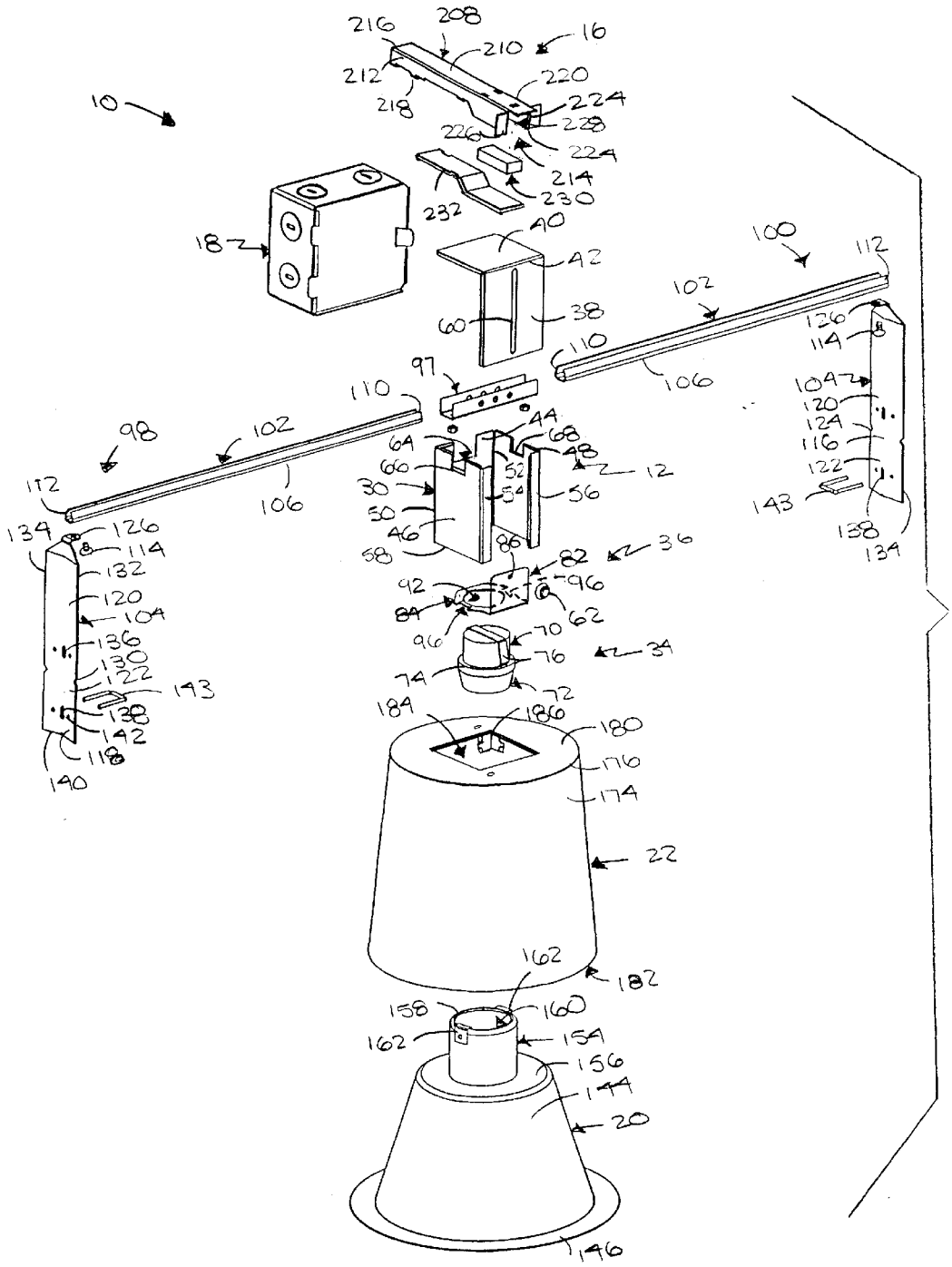
FIG. 4 is an exploded, perspective, view of the recessed downlight illustrated in FIG. 1.

Housing 30 is formed by two separable parts, as best seen in FIG. 4. The first part includes a front wall 38 and a top wall 40 extending substantially perpendicularly from a top edge 42 of front wall 38. The second part includes a rear wall 44 with opposing first and second sidewalls 46 and 48 extending substantially perpendicularly from first and second side edges 50 and 52, respectively, of rear wall 44. First and second sidewalls 46 and 48 have attachment lips 54 and 56 extending from the free edges of first and second sidewalls 46 and 48, respectively, opposite first and second side edges 50 and 52. Each lip 54 and 56 provides an attachment surface for securing the first and second parts of housing 30 together. Specifically, lips 54 and 56 are attached to the back surface of front wall 38 by any known attachment such as adhesive, bonding, and welding so that the top edges of rear wall 44 and sidewalls 46 and 48 abut the bottom surface of top wall 40.

Figure 8:
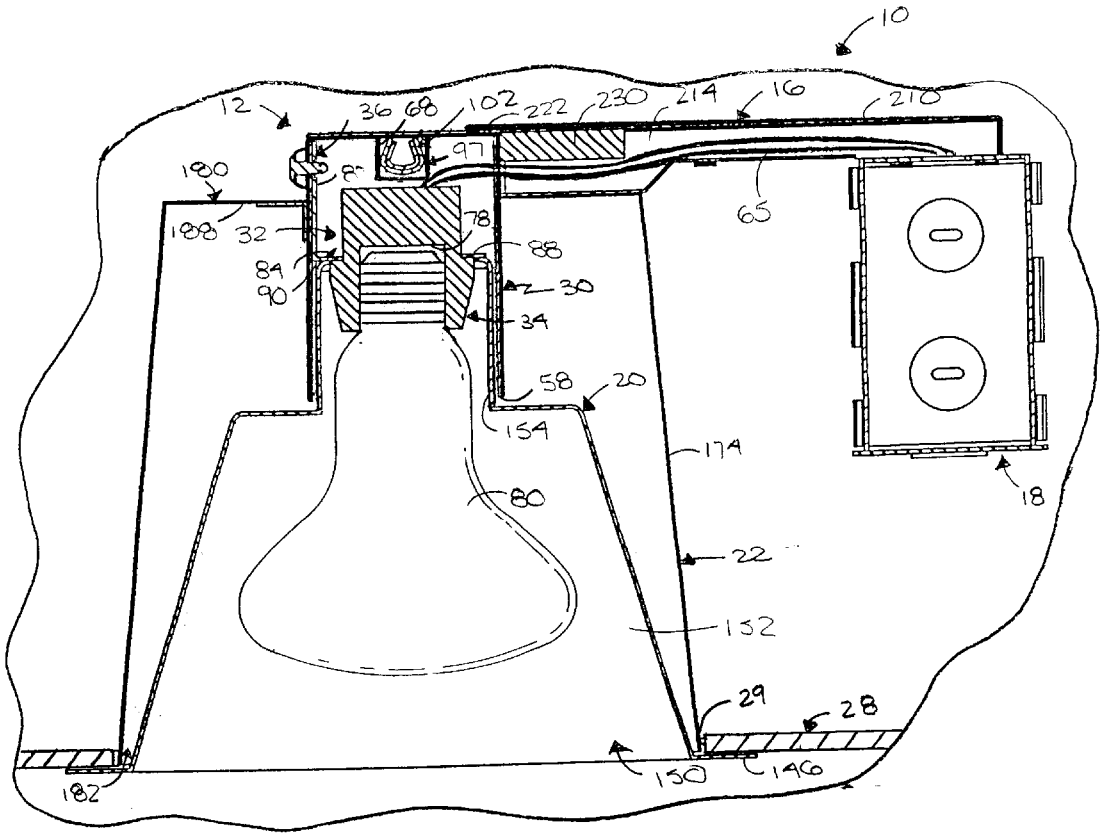
FIG. 8 is a right side elevational view in cross section of the recessed downlight taken along line 8—8 of FIG. 1.

Once attached, the first and second parts of housing 30 define inner area 32 with a bottom peripheral edge 58 of housing 30 being a free edge such that housing 30 has an open bottom for receiving trim 20, as seen in FIG. 8. The walls of housing 30 are substantially planar and form a substantially box-shaped housing. Although it is preferable to form housing 30 from two separate parts as described above, the housing 30 can be formed as a one piece, unitary housing or by separate front, rear, side, and top walls joined together.

Front wall 38 further includes an elongated slot 60 centrally disposed therein for receiving a fastener 62 that is coupled with socket bracket 36, as seen in FIGS. 2 and 8, thereby allowing actuation of socket bracket 36 by sliding fastener 62 up and down within slot 60. Rear wall 44 includes a wireway access opening 64 centrally disposed and formed in the top edge of rear wall 44 providing an access opening for wires 65 extending from junction box 18 through wireway 16 to socket 34. First and second sidewalls 46 and 48 similarly include first and second apertures or engagement surfaces 66 and 68, respectively, centrally disposed in the top edges of sidewalls 46 and 48 for engaging hanger bar assembly 14.

Socket 34 is preferably a one-piece, substantially cylindrical member with top and bottom sections 70 and 72 with top section 70 being smaller than bottom section 72, thereby forming a middle transition shoulder 74 therebetween, as seen in FIG. 4. A spring clip 76 extends over top section 70 that allows securement of socket 34 to bracket 36. Socket 34 includes an inner bore 78 for receiving a lamp 80, thereby electrically connecting lamp 80 via wires 65, as is well known in the art.

Figure 10:
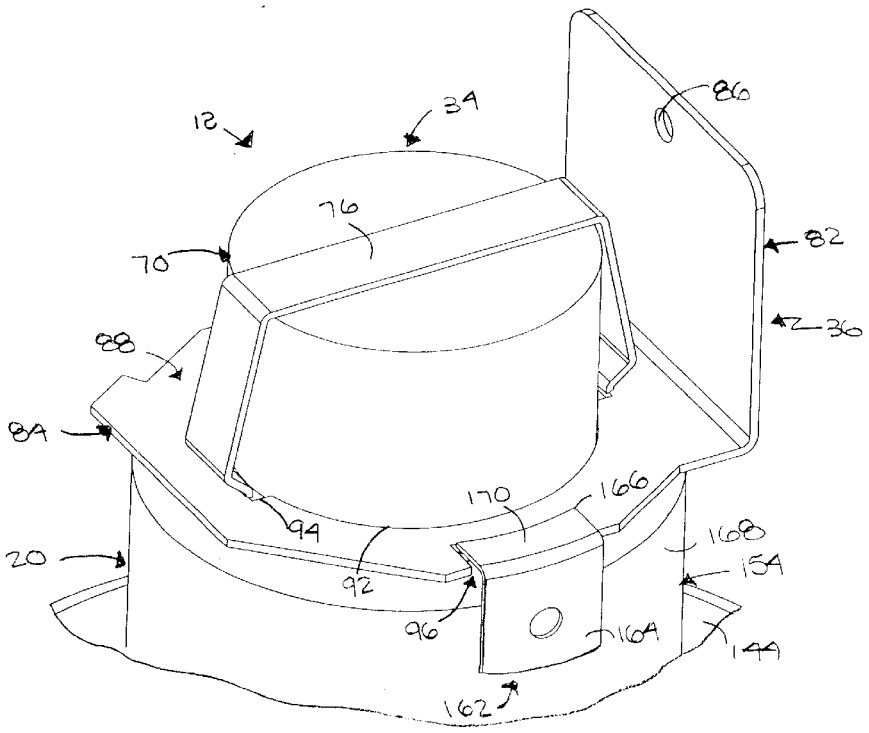
FIG. 10 is an enlarged, perspective View in elevation of the socket and the trim illustrated in FIG. 9, showing the first step in engaging the socket and the trim.
Figure 11:
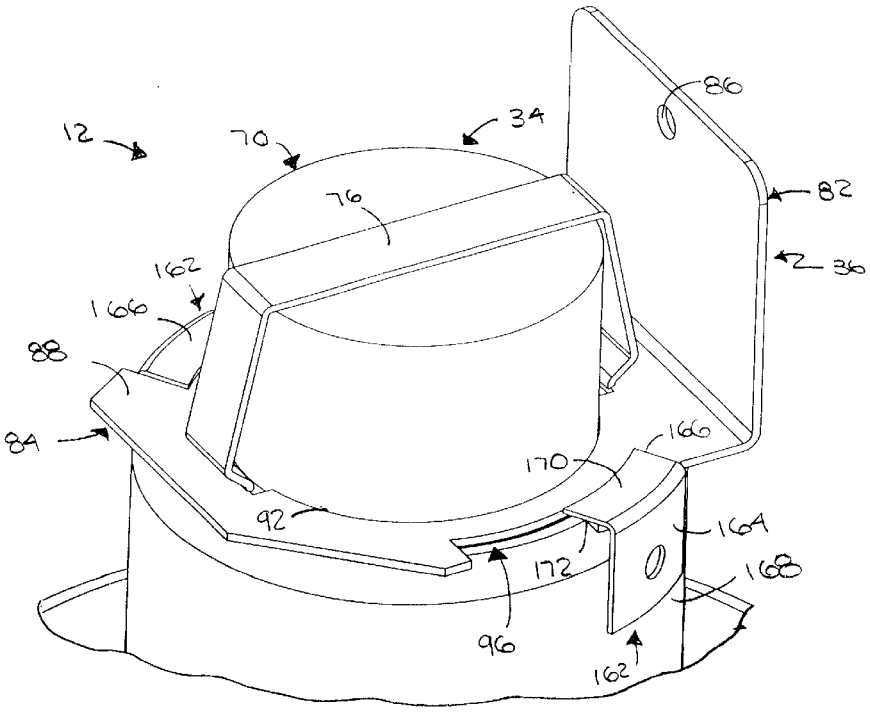
FIG. 11 is an enlarged, perspective view in elevation of the socket and the trim illustrated in FIG. 9, showing the second step in engaging the socket and the trim.

Socket bracket 36 includes first and second substantially planar portions 82 and 84 that form a generally ninety-degree angle therebetween. In particular, first portion 82 is adjacent to and substantially parallel with front wall 38 of socket box housing 30 and includes a fastener hole 86 near its top edge for receiving fastener 62 such that bracket 36 can be slidably moved up and down along the rear surface of wall 38 via fastener 62. Second portion 84 extends from the bottom edge of first portion 82 and includes opposing upper and lower planar surfaces 88 and 90 and a central aperture 92 for receiving top section 70 of socket 34. Central aperture 92 further has two opposing slightly inset portions 94 that allow spring clip 76 of socket 34 to clear central aperture 92 when securing bracket 36 and socket 34, as seen in FIGS. 4, 10, and 11. The outer perimeter of second portion 84 further includes two opposing notches 96 that receive retaining clips of trim 20. Notches 96 are substantially rectangular to accommodate the shape of the retaining clips of trim 20.

Socket box assembly 12 is supported by and slidably coupled to hanger bar assembly 14. A wireguard 97 is preferably included in engagement apertures 66 and 68 of the socket box assembly 12 to provide a barrier between hanger bar assembly 14 and wires 65 and to satisfy industry luminaire standards. However, wireguard 97 is not necessary for operation of downlight 10.

Figure 5:
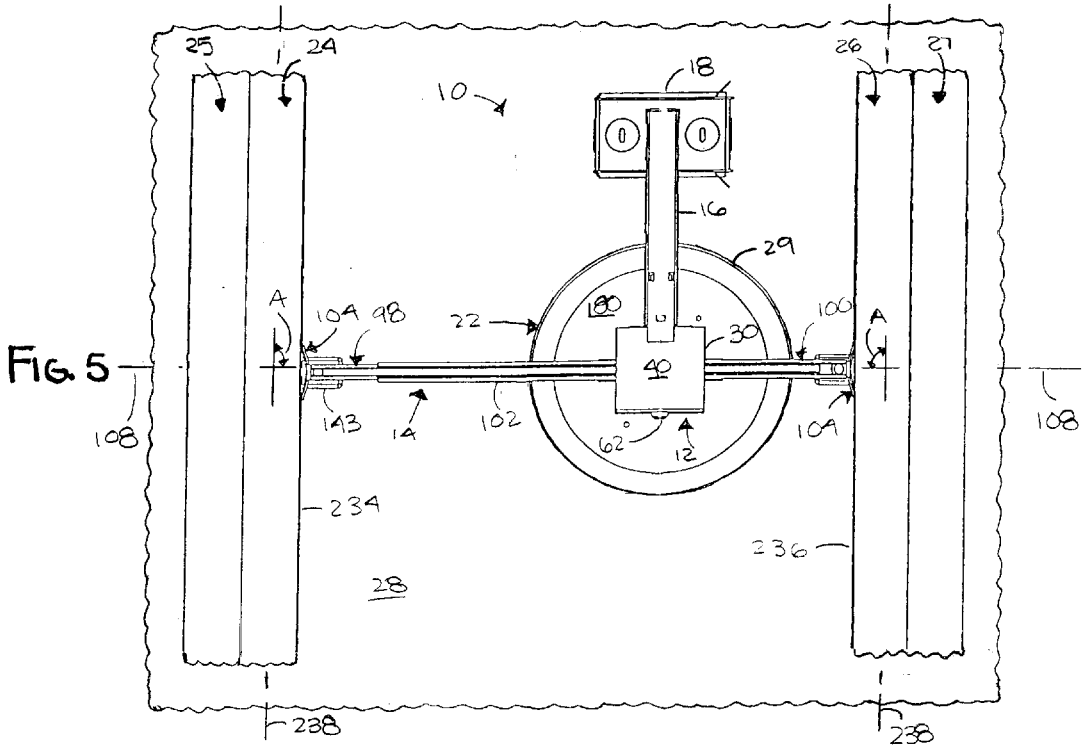
FIG. 5 is a top plan view of the recessed downlight illustrated in FIG. 1, showing the downlight secured between two joists and located off center relative to the joists.
Figure 6:
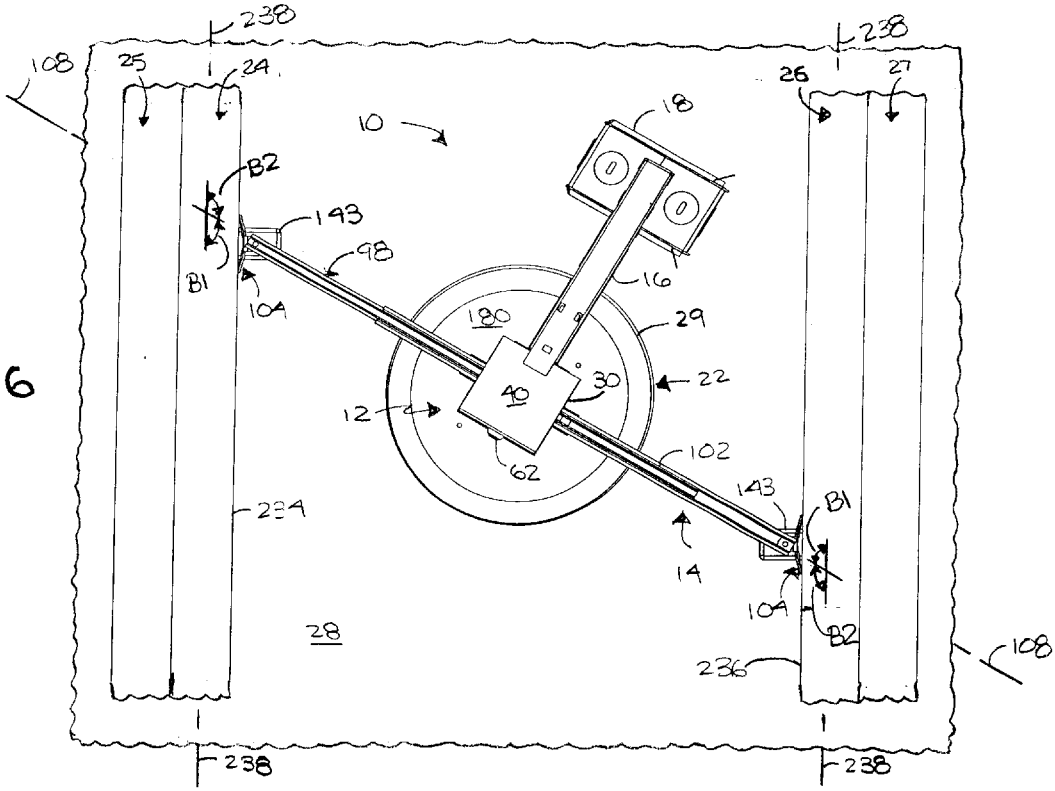
FIG. 6 is a top plan view of the recessed downlight illustrated in FIG. 1, showing the downlight secured between two joists and installed diagonally with respect to the joists.

Hanger bar assembly 14 generally includes first and second support members 98 and 100, as best seen in FIGS. 1–4. First and second support members 98 and 100 are attached to first and second joists 24 and 26, as seen in FIGS. 5 and 6, thereby suspending downlight 10 above ceiling 28. First and second support members 98 and 100 are substantially identical, therefore the same reference numerals with be used to describe both.

Each support member 100 and 98 includes first sections 102 and 102' and second sections 104 and 104', respectively. Section 102' is slightly smaller than section 102 allowing section 102 to receive section 102' in a telescopic sliding arrangement. First sections or hanger bars 102 and 102' are each an elongated substantially U-shaped channel member such that hanger bar 102 of support member 100 can slidably receive hanger bar 102' of support member 98. Thus, once the hanger bars 102 and 102' of first and second support members 100 and 98 are in engagement, the length of hanger assembly 14 can be adjusted by either pulling apart or pushing together first and second support members 98 and 100.

Figure 7:
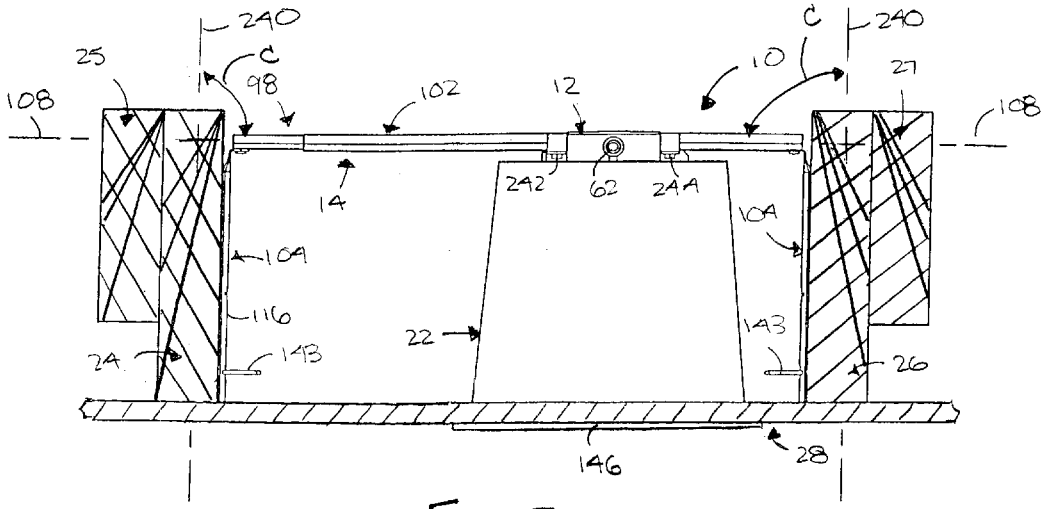
FIG. 7 is an elevational view of the recessed downlight illustrated in FIG. 5, showing the downlight secured between two joists and located off center.

The U-shaped outer surface of hanger bars 102 and 102' each includes a sliding surface 106 and 106', respectively, that directly engages housing 30 of socket box assembly 12. In particular, hanger bar 102 extends through engagement apertures 66 and 68 and inner area 32, thereby allowing housing 30 to slide along a longitudinal axis 108 of hanger bars 102 and 102', as best seen in FIGS. 5 and 7. In addition, housing 30 can rotate entirely around hanger bars 102 and 102'.

Hanger bar 102 further includes first and second opposing ends 110 and 112. First end 110 mates with hanger bar 102' of the opposing support member 98, as described above. Second end 112 mates with second section or vertical leg 104 such that vertical leg 104 is substantially perpendicular to hanger bar 102. In particular, second end 112 of hanger bar 102 includes a fastener hole that receives a fastener 114 about which second section or vertical leg 104 rotates. Fastener 114 can be any known fastener, such as a rivet or a screw.

Vertical leg 104 preferably includes a slightly convex inner surface 116 opposite a slightly concave outer surface 118, where the outer surface 118 abuts the joist or support structure when mounting downlight 10. This shape of vertical leg 104 provides the leg with greater strength so that it is less likely to bend. However, inner and outer surfaces 116 and 118 can be substantially planar. Vertical leg 104 comprises first and second unitary segments 120 and 122 with a frangible portion 124 centrally disposed between first and second segments 120 and 122. First segment 120 is rotatably coupled to second end 112 of hanger bar 104 by fastener 114. In particular, first segment 120 has an inwardly extending tab 126 with a pivot hole for receiving fastener 114, thereby securing vertical leg 104 to hanger bar 102 and allowing vertical leg 104 to rotate about a vertical axis 128. Vertical leg 104' is substantially identical to and the mirror image of vertical leg 104 and includes all of the same elements as vertical leg 104.

Frangible portion 124 specifically includes two small V-shaped notches 130 disposed in opposing side edges 132 and 134 of vertical leg 104, respectively. However, frangible portion 124 can be any known type of weakened section or portion, such as perforations, as long as second segment 122 can be relatively easily removed from first segment 120 without the use of a cutting tool. First and second securing surfaces or small slots 136 and 138 are disposed in first and second segments 120 and 122, respectively, and are sized to receive the end of a tool commonly used when installing a downlight, such as a screwdriver. Slots 136 and 138 can be located anywhere on first and second segments 120 and 122, but preferably first slot 136 is disposed close to the end of first segment 120 near V-notches 130 and second slot 138 is disposed close to the bottom free end 140 of second segment 122, as best seen in FIGS. 2–4. A pair of pin holes 142 are located on either side of first slot 136 and second slot 138, for receiving a staple 143 when mounting vertical leg 104 to a joist.

Turning now to trim 20, trim 20 can be any type of covering member such as a reflector, baffle, cone, ring, eyeball, wallwasher, or lens. Trim 20 serves three general purposes including providing a decorative cover and trim, dictating the height of socket box housing 30 once downlight 10 is installed, and positions the lamp with respect to the opening of the ceiling.

Trim 20 generally includes a main body 144 having a substantially frusto conical shape. However, main body 144 can be of various shapes, such as generally square or rectangular. A bottom lip 146 extends outwardly and around a bottom edge 148 of body 144 and a bottom opening 150 for engaging a bottom surface of ceiling 28. Main body 144 defines interior area 152 for receiving lamp 80 which can be installed and accessed through bottom opening 150. A top substantially cylindrical mounting portion 154 extends upwardly from main body 144. Top mounting portion 154 is sized to accommodate inner area 32 of socket box housing 30. A shoulder portion 156 connects main body 144 and the substantially smaller top mounting portion 154. A top free edge 158 of top mounting portion 154 defines a top opening 160 providing access to interior area 152. Top opening 160 is further sized to receive socket 34, as best seen in FIG. 8.

Trim 20 is releasably attached to socket box assembly 12 via trim securing elements or clips 162, as seen in FIGS. 8–11. Each clip 162 includes first and second substantially planar sections 164 and 166 that form a generally ninety-degree angle therebetween. First section 164 is attached to the outer surface 168 at one end with second section 166 extending inwardly toward top opening 160 from the opposing end of first section 164. Second section 166 particularly includes first and second planar surfaces 170 and 172 and is sized to accommodate notches 96 of socket bracket 36.

Figure 12:
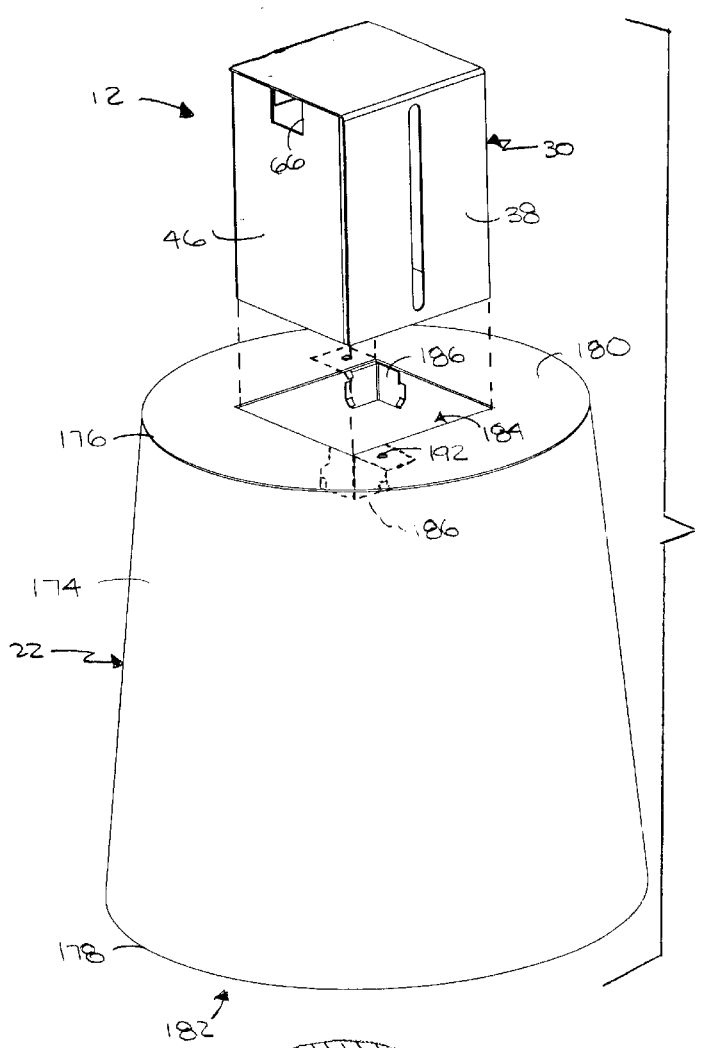
FIG. 12 is an exploded, perspective view of the socket assembly and the can housing of the recessed downlight illustrated in FIG. 1.

With respect to can 22, it is substantially cylindrical in shape, as seen in FIG. 1, but can be of various shapes, such as generally square or rectangular. Can 22 includes a main portion 174 with opposing top and bottom edges 176 and 178 with a top wall 180 extending from top edge 176 and bottom edge defining a bottom opening 182. Bottom opening 182 has a diameter greater than top wall 180 such that main portion 174 tapers from bottom edge 178 to top edge 176. Top wall 180 further includes a central opening 184 sized to receive socket box assembly 12, as seen in FIGS. 1 and 12. Preferably, central opening 184 is substantially square in shape to match the shape of socket box housing 30. However, central opening can be of any polygonal or circular shape as long as socket box housing 30 is closely received therein.

Figure 13:
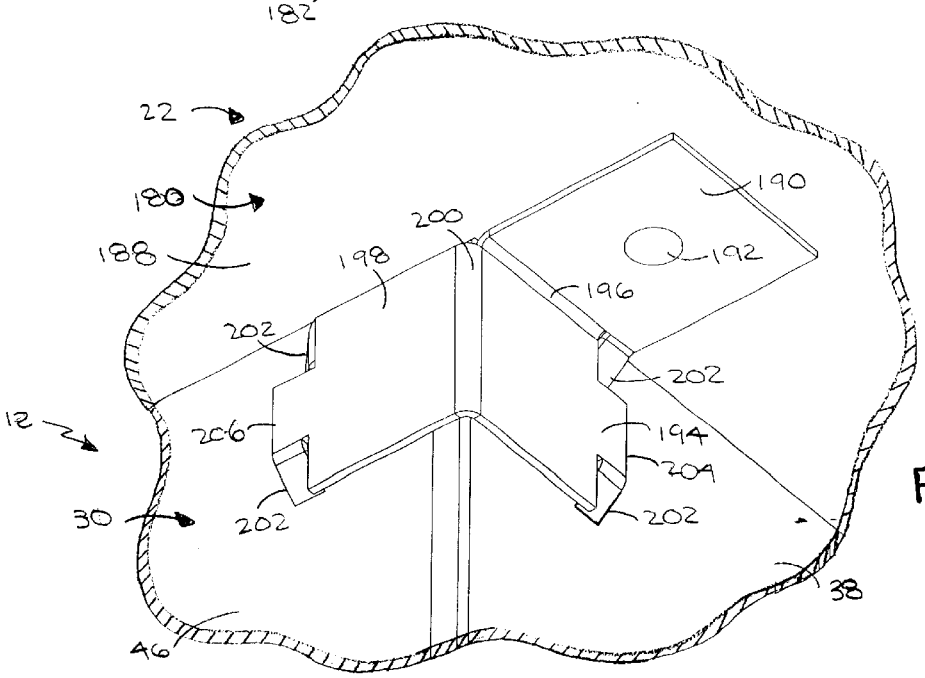
FIG. 13 is an enlarged, bottom perspective view of the socket assembly and the can housing illustrated in FIG. 12, showing the socket assembly and can housing engaged.

Cover securing elements or spring clips 186 attached to the bottom surface 188 of top wall 180 are employed to releasably attach can 22 to socket box assembly 12. Each clip 186 includes three unitary substantially planar sections. As seen in FIG. 13, first section 190 is attached to bottom surface 188 by a rivet 192 or any known fastener. Second section 194 extends downwardly and generally perpendicularly from first section 190 at a first edge 196. Third section 198 extends substantially perpendicularly from second section 194 at a second edge 200 that is generally perpendicular to first edge 196. Second and third sections 194 and 198 further include gripping teeth 202 for gripping the outer surface of socket box housing 30. In particular, a pair of gripping teeth 202 are disposed on second section 194 at a third edge 204 that is opposite and generally parallel to second edge 200. Similarly, a pair of gripping teeth 202 are disposed on third section 198 at a fourth edge 206 opposite second edge 200.

Wireway 16 extends between junction box 18 and socket box assembly 12 and supports junction box 18. Specifically, wireway 16 includes main channel portion 208 formed by an elongated substantially planar top wall 210 and two opposing substantially planar sidewalls 212 extending downwardly therefrom. An inner channel 214 for directly receiving wires 65 defines the inner surfaces of top wall 210 and sidewalls 212. Main channel portion 208 includes a first end 216 attached to junction box 18, preferably by engaging downwardly extending projections 218; however, any known attachment, such as by fastening or riveting, may be employed. Junction box 18 is a conventional junction box as is well known in the art and therefore will not be described herein.

A second end 220 of wireway 16 opposite first end 216 is secured to socket box assembly 12. In particular, top wall 210 at second end 220 includes an overhang portion 222 that directly engages the upper surface of top wall 40 of socket box assembly 12, as seen in FIGS. 2 and 3. Sidewalls 212 extend from and along top wall 210 and end at terminal edges 224 just prior to overhang portion 222. An attachment flange 226 extends outwardly from each terminal edge 224 for attachment to the outer surface of socket box housing 30 at rear wall 44. A channel access opening 228 is defined between terminal edges 224 and aligns with wireway access opening 64 in rear wall 44 of socket box housing 30.

As seen in FIGS. 4 and 8, a thermal sensor 230 is disposed within inner channel 214, secured thereto by a bracket 232 attached to top wall 210. By placing thermal sensor 230 in wireway 16, the installation and removal of trim 20 and can 22 is not obstructed by the sensor, while being close enough to socket 34 to effectively detect overheating.

Assembly of Downlight of FIGS. 1–15

Referring to FIGS. 1–15, assembly and installation of downlight 10 initially requires assembly of socket box assembly 12 and hanger bar assembly 14. In particular, hanger bars 102 of first and second support members 98 and 100 of hanger bar assembly 12 are slidably coupled in a telescopic arrangement and extended through first and second engagement apertures 66 and 68 of socket box housing 30 such that housing 30 can slidably traverse hanger bars 102. Wireguard 97 is placed in and between apertures 66 and 68 with hanger bars 102 being disposed in the channel of wireguard 97, thereby providing a barrier between hanger bars 102 and wires 65.

Vertical legs 104 and 104' are then attached to the second ends 112 of hanger bars 102 and 102' by inserting fasteners 114 through the holes in tabs 126 of vertical legs 104. Tightening or riveting fasteners 114 secures vertical legs 104 and 104' to hanger bars 102 and 102' and allows them to rotate with respect to hanger bars 102 and 102'. Alternatively, vertical legs 104 and 104' can be attached prior to coupling hanger bars 102 and 102'.

Wireway 16 is attached to junction box 18 at the first end of the wireway. The second end 220 of wireway 16 is attached to socket box housing 30 by securing attachment flanges 226 of wireway 16 to rear wall 44 of housing 30 such that channel access opening 22 of wireway 16 aligns with opening 64 in rear wall 44, and overhang portion 22 rests on the upper surface of top wall 40 of socket box housing 30. Thermal sensor 230 can be secured to top wall 210 of wireway 16, either prior to or after connecting wireway 16 to junction 18 and socket box housing 30.

Once the socket box and hanger bar assemblies 12 and 14 are assembled as described above and seen in FIG. 2, downlight 10 can be installed between joists 24 and 26. Generally, downlight 10 is placed between joists 24 and 26 and vertical legs 104 and 104' are secured to each joist, respectively. As such, only two mounting points, one on joist 24 and a second on joist 26, are required to adequately secure downlight 10 in the installation space. Specifically, the outer concave surfaces 118 of vertical legs 104 and 104' of each support member 98 and 100 are placed against the face or inner surfaces 234 and 236 of joists 24 and 26, respectively, and staples 143 are inserted into each pair of pin holes 142 to secure vertical legs 104 and 104' to joists 24 and 26, thereby suspending downlight 10 between joists 24 and 26. Downlight 10 can be oriented such that either support member 98 and 100 is attached to either joist 24 and 26. Also, wireway 16 and junction box 18, which extend from socket box assembly 12, can be oriented on either side of hanger bar assembly 14, that is, either in front of or behind socket box housing 30.

As seen in FIGS. 5–7, hanger bar assembly 14 of downlight 10 can be oriented in two positions with respect to joists 24 and 26, either generally perpendicular to a horizontal axis 238 of joists 24 and 26 defined along the length of the joists, or substantially diagonal to horizontal axis 238. In the first position, the installer can adjust the length of the hanger bar assembly 14 to accommodate the installation space by pushing and pulling apart the telescoping hanger bars 102 and 102' and then attaching vertical legs 104 and 104' to the joists. However, if hanger bars 102 and 102' cannot adequately adjust to the space between the joists and/or there are obstacles in the installation space, the installer can mount the hanger bar assembly 14 in the second position or diagonally, as seen in FIG. 6. Specifically, vertical legs 104 and 104' rotate with respect to vertical axis 128 allowing hanger bars 102 and 102' to fit diagonally between joists 24 and 26 with vertical legs 104 and 104' being secured to joists 24 and 26, as described above.

In the first position, hanger bars 102 and 102' of support members 100 and 98 define horizontal angle A with respect to horizontal axis 238 of joists 24 and 26 and longitudinal axis 108 that is generally ninety-degrees, as best seen in FIG. 5. In the second position, hanger bars 102 and 102' define horizontal angles B1 and B2 with respect to horizontal axis 238 and longitudinal axis 108. B1 is generally an acute angle and B2 is generally an obtuse angle, as best seen in FIG. 6. In both positions, hanger bars 102 and 102' define a vertical angle C with respect to a vertical axis 240 defined along the height of joists 24 and 26 that is generally ninety-degrees, as best seen in FIG. 7.

Vertical legs 104 and 104' can also be adjusted to accommodate different joists with various heights. As seen in FIG. 7, vertical legs 104 and 104' would be too long to fit against joists 25 and 27 which are substantially shorter than joists 24 and 26. However, second segment 122 of vertical legs 104 and 104' can be removed such that only first segment 120 remains, thereby adjusting to the height of the shorter joists 25 and 27. To remove second segment 122, the installer simply employs standard tools, such as screwdrivers. Specifically, the ends of the screwdrivers are inserted into first and second small slots 136 and 138 of first and second segments 120 and 122, respectively, and twisted until frangible portion 124 breaks, thereby separating first and second segments 120 and 122.

Slots 136 and 138 in vertical legs 104 and 104' provide a visual indication to the installer when securing vertical legs 104 and 104' to joists 24 and 26 by allowing the installer to see centering lines marked on the joists. Notches 135 disposed at the ends of vertical legs 104 and 104' also facilitate centering thereof.

Figure 14:
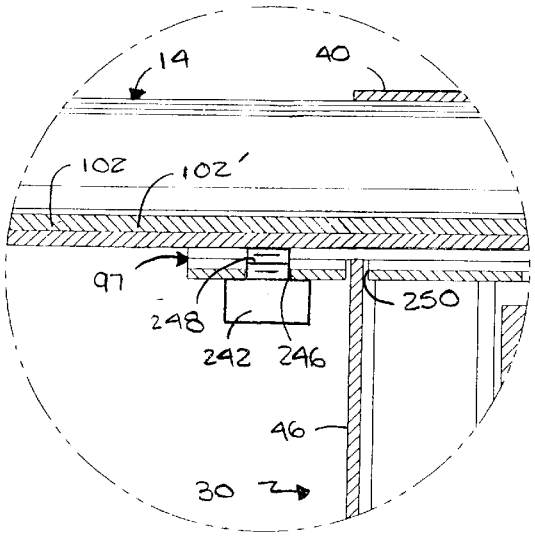
FIG. 14 is an enlarged sectional view of the socket assembly and the hanger bar assembly of the recessed downlight illustrated in FIG. 1, showing the engagement of a wireguard and the socket and hanger bar assemblies.

Once mounted in either the first or second position, socket box assembly 12 can be adjusted to a desired location or adjusted to avoid various obstacles in the installation area. Specifically, socket box housing 30 can slide along longitudinal axis 108 of hanger bars 102 and 102'. Once a desired location is found, first and second fasteners 242 and 244 are inserted through wireguard 97 and against hanger bars 102 and 102', on either side of housing 30, as seen in FIGS. 7 and 14. In particular, each fastener insert 242 and 244 is inserted through an opening 246 disposed proximate each end of wireguard 97, respectively, and tightened, with the stem 248 of each fastener insert 242 and 244 abutting the bottom of hanger bars 102 and 102', as best seen in FIG. 14 (showing only fastener insert 242). Hanger bars 102 and 102' will in turn be forced against the bottom surface of top wall 40 of housing 30, thereby substantially preventing rotation of housing 30 with respect to axis 108. In addition, wireguard 97 includes a notch 250 which receives socket box housing sidewall 46 at first engagement aperture 66, which substantially prevents housing 30 from sliding transversely across hanger bars 102 and 102'.

If wireguard 97 were not used, first and second fastener inserts 242 and 244 would be inserted through hanger bars 102 and 102', thereby substantially restricting housing 30 from sliding with respect to longitudinal axis 108.

Can 22 can next be mounted to socket box assembly 12 by inserting socket box housing 30 into central opening 184 until top wall 180 either abuts or is slightly spaced from fastener inserts 242 and 244, as seen in FIGS. 1 and 7. Spring clips 186 act to frictionally engage the outer surface of socket box housing 30. Specifically, second section 194 of one of the spring clips 186 grips front wall 38 of housing 30 via gripping teeth 202 and third section 198 grips sidewall 46 via teeth 202 at the desired location along the height of socket box housing 30, as best seen in FIG. 13. The other spring clip 186 can be applied to an opposing corner of housing 30. It will be understood that spring clips can engage any corner of housing 30. Clips 186 also act to stabilize housing 30 with respect to can 22 by gripping four walls of housing 30 via teeth 202.

Since can 22 is lightweight and made of a thin metal, the frictional engagement maintains can 22 in the desired location. To remove and/or replace can 22, the installer merely pulls can 22 downwardly, thereby overcoming the frictional engagement.

Ceiling 28 is then mounted in place with an aperture cut therein at a desired location either prior to or after ceiling 28 is mounted. Can 22 can be inserted in place after ceiling 28 is mounted rather than before by inserting can 22 through aperture 29 of ceiling 28 and engaging socket box housing 30. Again, socket box housing 30 can be adjusted and moved to be directly above the ceiling aperture by sliding it along hanger bars 102, as describe above. Once the ceiling is in place, trim 20 is mounted to socket box assembly.

Figure 9:
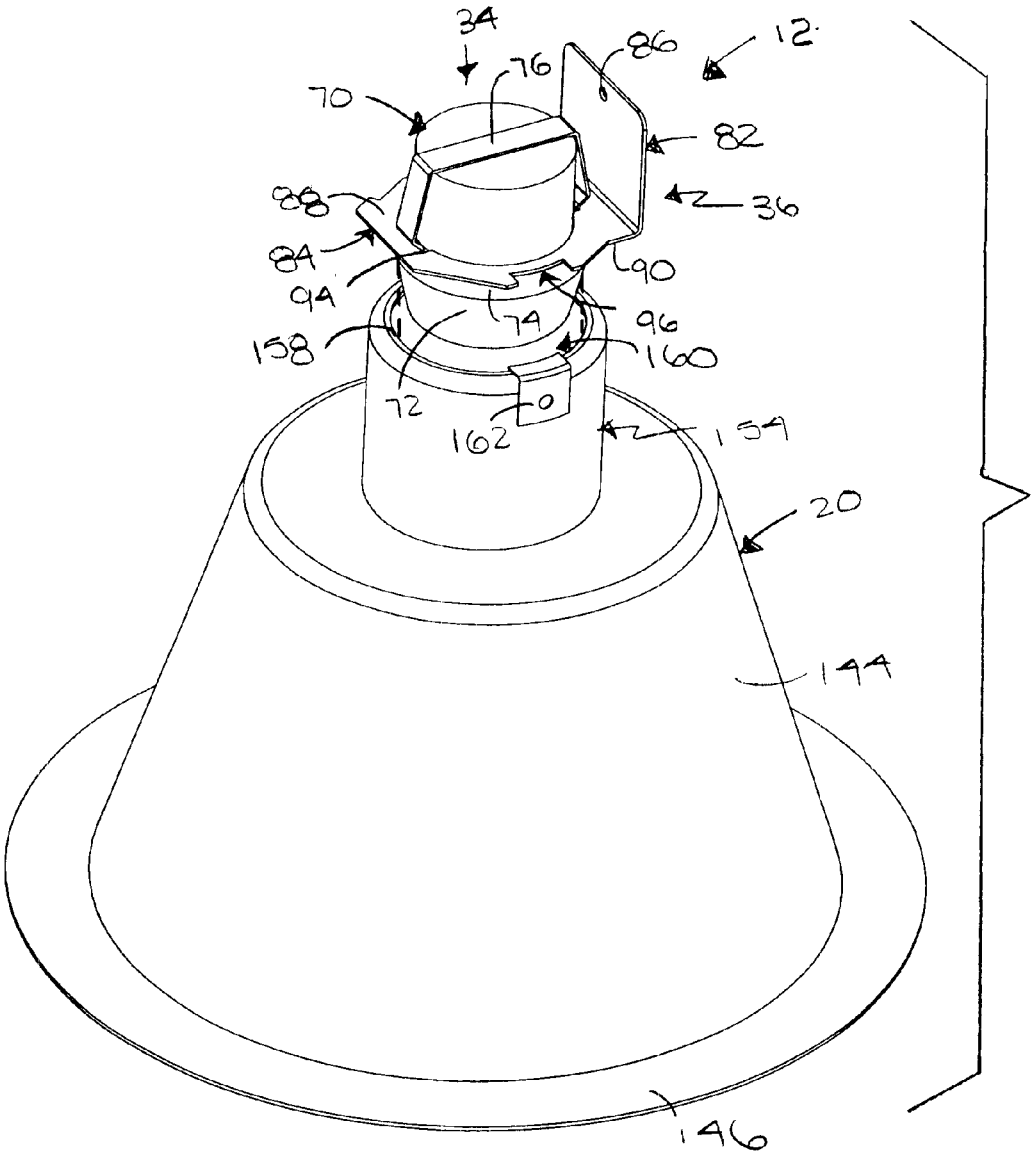
FIG. 9 is an exploded, perspective view of a socket and a trim of the recessed downlight illustrated in FIG. 8.

To secure trim 20 to socket box assembly 12, socket 34 and socket bracket 36 are slided downwardly by moving fastener 62 downwardly along slot 60 in housing 30 until fastener 62 abuts the bottom of slot 60. As seen in FIGS. 9–11, trim 20 can then be releasably engaged with socket bracket 34 by inserting bottom section 72 of socket 32 into top opening 160 of trim 20 and engaging trim clips 162 with socket bracket 36. In particular, trim 20 must be rotated until clips 162 align with notches 96 of bracket 38, as best seen in FIG. 10. Once aligned, clips 162 can be inserted up and through notches 96. Trim 20 is then rotated again so that lower surfaces 172 of clips 162 rest on upper surface 88 of bracket 36, as seen in FIG. 11, thereby securing trim 20 to socket bracket assembly. The assembly of trim 20, socket 34 and bracket 36 can then be moved or pushed upwardly with fastener 62 sliding upwardly along slot 60 of housing until bottom lip 146 abuts ceiling 28, as seen in FIG. 8. By tightening fastener 62 prior to mounting trim 20, a frictional engagement between first planar portion 82 of bracket 36 and the inner surface of front wall 38 is created. The frictional engagement between bracket 36 and front wall 38 will hold trim 20 in place due to its light weight.

The height of trim 20 with respect to ceiling 28 can be adjusted according to the thickness of ceiling 28. In particular, the length of socket box assembly 30 and its slot 60 allowing trim 20 to be vertically adjusted until lip 146 abuts the bottom of ceiling 28 by moving fastener 62 and trim 20 up and down with respect to socket box housing 30.

To remove and/or replace trim 20, the installer pulls the trim 20 down, thereby also pulling socket 34 and socket bracket 36 down. Trim 20 can then be rotated with clips 162 sliding along upper surface 88 of bracket 36 until they are aligned with notches 96. Clips 162 can then be dropped through notches 96, thus releasing trim 20 from bracket 36. It will be understood that notches 96 and clips 162 can be any desired shape, such as rectangular, square, or circular, and be different shapes as long as clips 162 can pass through notches 96.

The releasable connections of can 22 and trim 20 allow the installer to easily remove or replace variously sized cans and trims independently of one another. Therefore, the installer can replace only can 22, or only trim 20, or both can 22 and trim 20. Moreover, the connections of can 22 and trim 20 allow the installer to mount each without the use of tools, thereby facilitating installation of downlight 10.

Downlight 10 can also be employed in retro-fit applications. In retro-fit applications where a wall board type ceiling is already in place, hanger bar assembly 14 is removed from downlight 10 so that socket box assembly 12, junction box 18, and a can designed for retro-fit applications (not shown), can then be inserted up and through a ceiling aperture 29 and mounted to the ceiling by retaining clips extending from the retro-fit can which engage the upper surface of the ceiling. Trim 20 can then be mounted as described above.

Figure 15:
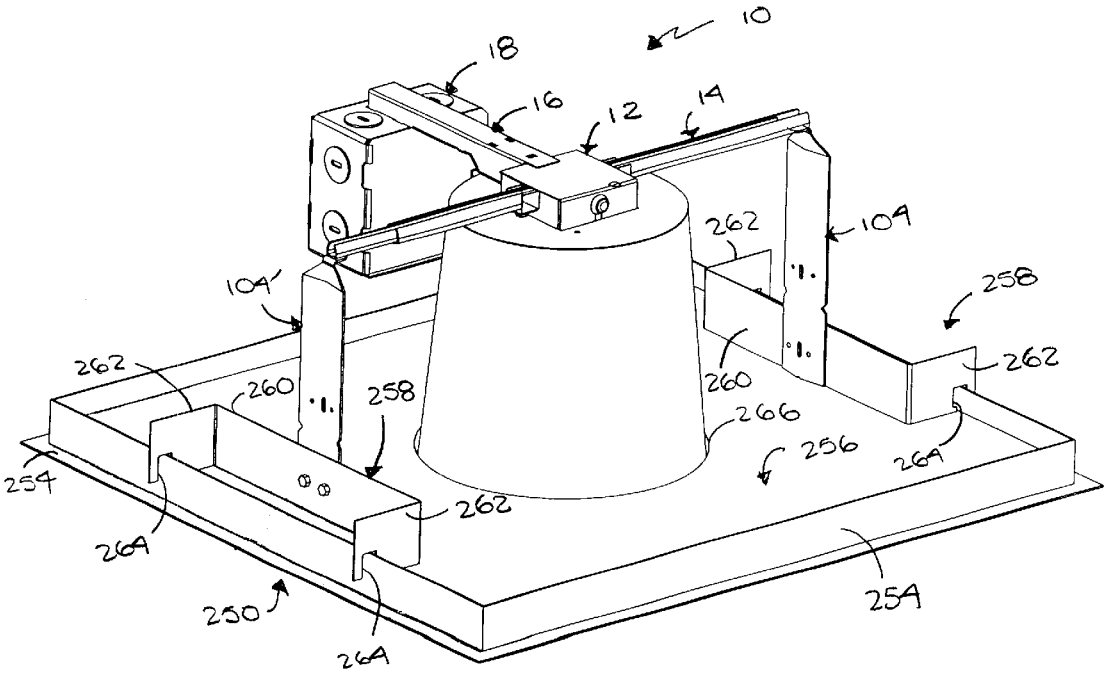
FIG. 15 is a perspective view in elevation of the recessed downlight illustrated in FIG. 1, showing the downlight mounted to a suspended T-bar ceiling.

As seen in FIG. 15, applications where a suspended T-bar 250 is in place, downlight 10 is mounted to a T-bar support 254 above a tile 256 of ceiling 250. T-bar or mounting clips 258 that attach to and extend from each vertical leg 104 and 104' engage T-bar support 254, thereby supporting downlight 10. Clips 258 each include a generally planar and elongated main portion 260 with an arm portion 262 extending from opposing ends of main portion 260 at a generally ninety degree angle therefrom. A slot 264 is disposed in each arm portion 262 that receives T-bar support 254. A trim and can may be then be installed through an aperture 266 in tile 256 in the same manner as described above with respect to ceiling 28.

Figure 16:
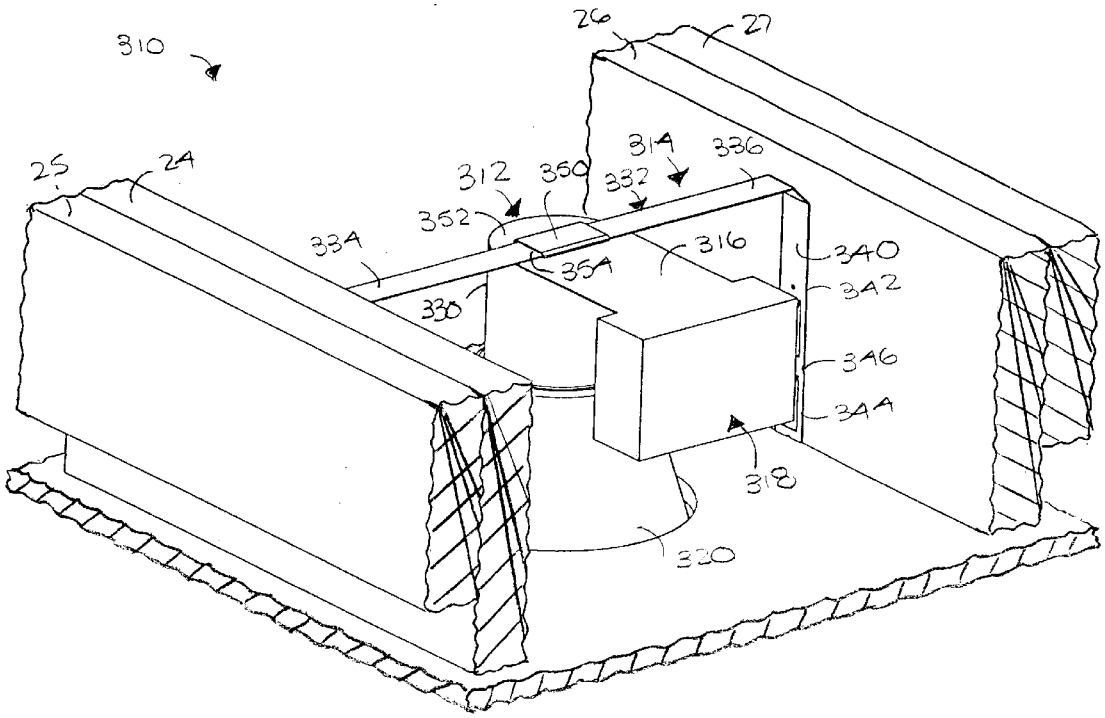
FIG. 16 is a perspective view in elevation of a recessed downlight according to a second embodiment of the present invention, illustrating the recessed downlight secured between two joists.
Figure 17:
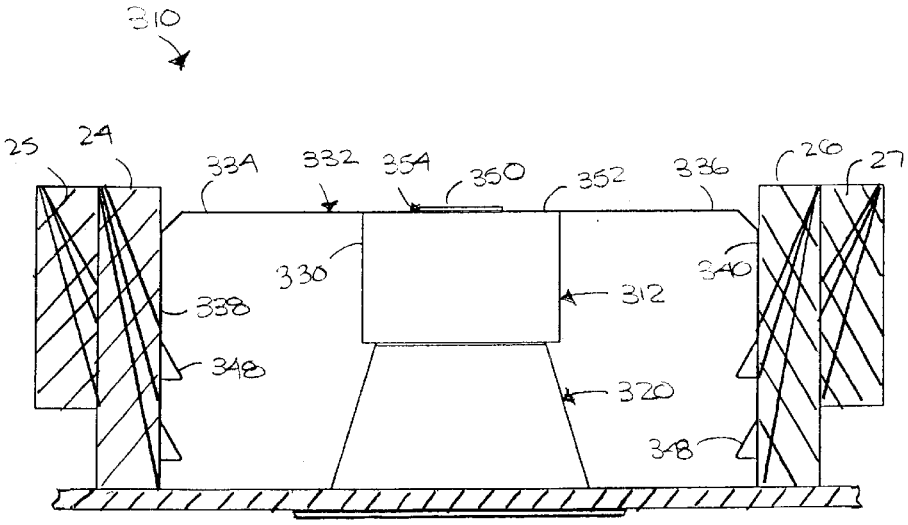
FIG. 17 is a front elevational view of the recessed downlight illustrated in FIG. 16, showing the downlight secured between the two joists.

Embodiment of FIGS. 16–17

Referring to FIGS. 16–17, a downlight 310 according to a second embodiment of the present invention is substantially similar to downlight 10 and therefore only a description of their distinctions will be set forth in detail. Downlight 310 comprises a socket box assembly 312 slidably coupled with a hanger bar assembly 314 with a junction box 318 attached to socket box assembly 312 by a bracket 316, similar to downlight 10. Hanger bar assembly 314 comprises two bars, slidably engaged. Socket box assembly 312 includes a housing 330 that holds a socket assembly similar to the socket assembly of downlight 10. In addition, a trim 320 is releasably mounted to socket box assembly 312 in the same fashion as trim 20 of downlight 10.

Downlight 310 differs from downlight 10 in that hanger bar assembly 314 includes a support member 332 having opposing slidable sections 334 and 336. Vertical legs 338 and 340 extend substantially perpendicularly from each end 334 and 336, respectively, for attachment to joist 24 and 26. Like vertical legs 104 of downlight 10, vertical legs 338 and 340 each includes first and second segments 342 and 344 with a frangible portion 346 therebetween. Each first and second segment 342 and 344 includes an inwardly extending integral clip 348 for facilitating fastening vertical legs 338 and 340 to the joists.

Socket box housing 330 also slightly differs from socket box housing 30 of downlight 10. Specifically, rather than employing engagement apertures through which hanger bar assembly 314 can extend through, an extension portion 350 is disposed preferably on a top surface 352 of housing 330, thereby forming a slot or engagement surface 354 between extension portion 350 and top surface 352 for engaging hanger bar assembly 314. Like socket box assembly 12 of downlight 10, this allows socket box assembly 312 to slide along the length of support member 332. Slot 354 can be located on any surface of socket box housing 330, as long as housing 330 can slide along support member 332.

As seen in FIGS. 16–17, downlight 310 is installed in the same fashion as downlight 10. However, coupling of socket box assembly 312 and hanger bar assembly 314 varies slightly from socket box assembly 12 and hanger bar assembly 14 of downlight 10. Specifically, support member 332 of hanger bar assembly 314 is inserted through external slot 354 on socket box housing 330 such that housing 330 can slide along the length of support member 332.

Similar to vertical legs 104 of downlight 10, tools can be inserted through slots to separate second segment 344 from first segment 342 at frangible portion 346, to adjust to shorter joists 25 and 27. The remainder of downlight 310 is mounted in the same fashion as downlight 10.

Figure 18:
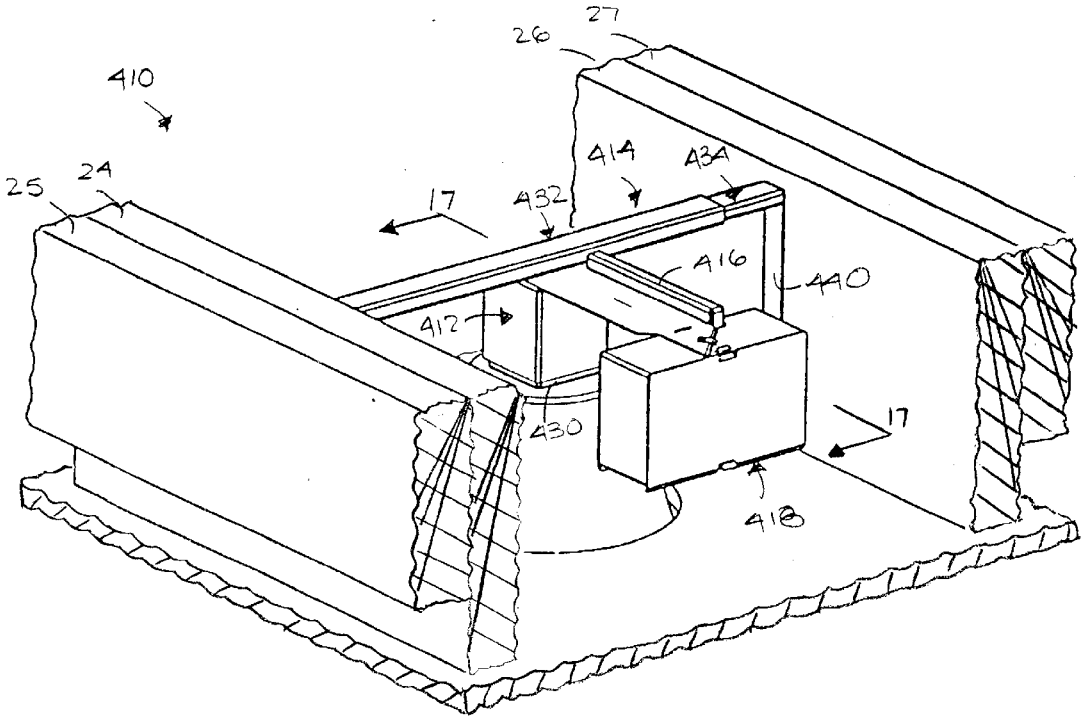
FIG. 18 is a perspective view in elevation of a recessed downlight according to a third embodiment of the present invention, illustrating the recessed downlight secured between two joists.
Figure 19:
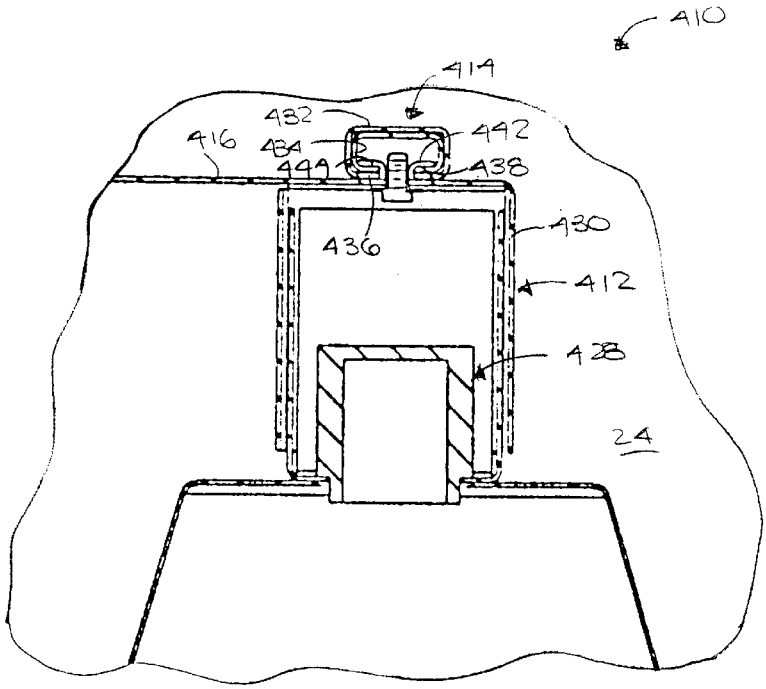
FIG. 19 is an enlarged right side elevational view in cross section of the recessed downlight taken along line 19—19 of FIG. 18, illustrating the engagement of the socket assembly and the hanger bar assembly.

Embodiment of FIGS. 18–19

Referring to FIGS. 18 and 19, a downlight 410 according to a third embodiment of the present invention is substantially similar to downlight 10 and therefore only their distinctions will be described in detail. Downlight 410 comprises a socket box assembly 412 slidably coupled with a hanger bar assembly 414 with a junction box 418 attached to socket box assembly 412 by a bracket 416, similar to downlight 10. Socket box assembly 412 includes a housing 430 that holds a socket assembly 428. In addition, a trim 420 is releasably mounted to socket box assembly 412 in the same fashion as trim 20 of downlight 10.

Hanger bar assembly 414 is similar to hanger bar assembly 14 of downlight 10 in that it includes two telescoping support members 432 and 434. However they differ in that support members 432 and 434 each have a substantially inverted U-shape and each includes two inwardly extending flanges or tracks 436 or 438, as best seen in FIG. 19. A vertical leg 440 extends from one end of each of the support members 432 and 434, and the legs are attached, respectively, to joists 24 and 26 in the same fashion as vertical legs 104 of downlight 10.

Socket box assembly 412 differs from socket box housing 12 of downlight 10 in that the top wall of socket box housing 430 includes an upstanding hook portion 442 for engaging either of track 436 and 438. Thus housing 430 is allowed to slide along the length of support members 432 and 434 by sliding hook portion 442 along either track 436 or track 438.

As seen in FIGS. 18-19, downlight 410 is also installed in the same fashion as downlight 10. Coupling of hanger bar assembly 414 and socket box assembly 412 differs from hanger bar assembly 14 and socket box assembly 12 of downlight 10. In particular, upstanding hook portion 442 of socket box housing 430 engages track 438, thereby securing hanger bar assembly 414 and socket box assembly 412 together. Socket box housing 430 can then slide along the length of support members 432 and 434 via track 438. Hook portion 442 can also engage track 436 instead of hook 438. Preferably, a second hook portion 444 extending from housing 430 is employed so that each track 436 and 438 will be engaged with a hook portion of housing 430. The remainder of downlight 410 is installed in the same manner as downlight 10.

While particular embodiments have been chosen to illustrate the invention, it will be understood by those skilled in the art that various changes and modifications can be made therein without departing from the scope of the invention as defined in the appended claims.

What is claimed is:

1. A lighting fixture, comprising:

a housing having an inner area for holding a socket assembly, and including an engagement surface; and a first support member coupled to said housing, and having a longitudinal axis, and first and second sections, said first section having a sliding surface for engaging said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis, and said second section being substantially perpendicular to said first section and has a vertical axis, and has first and second segments, said first segment includes said first securing surface, and second segment includes a second securing surface, for adjustably securing said first support member to a first support structure with respect to said vertical axis.

2. A lighting fixture, comprising:

a housing having an inner area for holding a socket assembly, and including an engagement surface; and a first support member coupled to said housing, and having a longitudinal axis, and first and second sections, said first section having a sliding surface for engaging said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis, and said second section of said first support member engages said first support structure thereby defining a first horizontal angle and a first vertical angle between said first section of said first support member and said first support structure, said first horizontal angle being either one of an obtuse angle and an acute angle, and said first vertical angle being substantially ninety degrees.

3. A lighting fixture, comprising:

a housing having an inner area for holding a socket assembly, and including first and second engagement surfaces;

a first support member coupled to said housing, and having a longitudinal axis, and first and second sections, said first section having a sliding surface for engaging said housing, said second section having a first securing surface for engaging a first support structure, and said sliding surface of said first section engaging said first engagement surface of said housing, thereby supporting said housing on said first support member and allowing said housing to slidably traverse said first support member along said longitudinal axis, said sliding surface of said first support member engages said first and second engagement surfaces;

a first fastener insert engaged with said first section proximate said housing at said first engagement surface;

a second fastener insert engaged with said first section proximate said housing at said second engagement surface, such that said first and second fastener inserts substantially restrict said housing from moving traversely with respect to said longitudinal axis of said first support member; and a wireguard located between said first section and said first and second engagement surfaces of said housing, and between said first and second fastener inserts with said first and second fastener inserts extending through said wireguard, said wireguard substantially restricting said housing from rotating with respect to said longitudinal axis.

4. A lighting fixture, comprising:

a housing having an inner area for holding a socket assembly, and including an engagement surface; and a first support member coupled to said housing, and having a longitudinal axis, and first and second sections, said first section having a sliding surface for engaging said housing, said first section extending into said inner area of said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis.

5. A lighting fixture according to claim 4, wherein said engagement surface is a first engagement surface;

said housing includes a second engagement surface; and said sliding surface of said first support member engages said first and second engagement surfaces.

6. A lighting fixture according to claim 5, wherein each of said first and second engagement surfaces of said housing is a first and second engagement aperture, respectively, so that said first section extends through each of said first and second engagement apertures.

7. A lighting fixture according to claim 5, further comprising a first fastener insert engaged with said first section proximate said housing at said first engagement surface; and a second fastener insert engaged with said first section proximate said housing at said second engagement surface, such that said first and second fastener inserts substantially restrict said housing from moving traversely with respect to said longitudinal axis of said first support member.

8. A lighting fixture according to claim 4, further comprising a second support member slidably coupled to said first support member, said second support member having a securing surface for securing to a second support structure.

9. A lighting fixture according to claim 8, wherein said inner area of said housing holds said socket assembly for connection to a junction box, and said socket assembly includes a socket for electrical connection to a lamp.

10. A lighting fixture, comprising:

a housing having an inner area for holding a socket assembly, and including an engagement surface; and a first support member coupled to said housing, and having a longitudinal axis, and first and second sections, said first section having a sliding surface for engaging said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis, and said first section of said first support member having a support flange, said support flange including said sliding surface, and said housing having an outwardly extending hook portion, said hook portion includes said engagement surface so that said hook portion slidably engages said support flange.

11. A lighting fixture, comprising:

a housing having an inner area for holding a socket assembly, and including an engagement surface; and a first support member coupled to said housing, and having a longitudinal axis, and first and second sections, said first section having a sliding surface for engaging said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis, and said first and second sections being separate sections, and said second section is rotatably connected to said first section.

12. A lighting fixture, comprising:

a housing having an inner area holding a socket assembly therein, and including an engagement surface; and a first support member slidably coupled to said housing, said first support member including a first section and a second section substantially perpendicular to said second section, said first section having a sliding surface engaging said engagement surface of said housing, said second section having a mounting member extending therefrom receiving a support structure, and said mounting member includes a slot disposed therein for receiving said support member.

13. A lighting fixtre according to claim 12, wherein said mounting member is a clip; and said support structure is a substantially planar bar.

14. A lighting fixture, comprising:

a housing having an inner area for holding a socket assembly, and including an engagement surface, said inner area of said housing holds said socket assembly for connection to a junction box, said socket assembly includes a socket for electrical connection to a lamp, and said socket includes a lower flange for supporting a first cover;

a first support member coupled to said housing, and having a longitudinal axis, and first and second sections, said first section having a sliding surface for engaging said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis;

a second support member slidably coupled to said first support member, said second support member having a securing surface for securing to a second support structure.

15. A lighting fixture according to claim 14, further comprising a wireway extending from said housing to said junction box, said wireway including a thermal sensor.

16. A lighting fixture, comprising:

a housing having an inner area for holding a socket assembly, and including an engagement surface; and a first support member slidably coupled to said housing, and having a first section, and a second section substantially perpendicular to said first section, said first section having a sliding surface for engaging said engagement surface of said housing, and said second section having first and second segments, each of said first and second segments including first and second securing surfaces defined along a vertical axis, respectively, for adjustably securing said first support member to a first support structure with respect to said vertical axis.

17. A lighting fixture according to claim 16, wherein said second section of said first support member engages said first support structure thereby defining a first horizontal angle and a first vertical angle between said first section of said first support member and said first support structure, said first horizontal angle being either one of an obtuse angle and an acute angle, and said first vertical angle being substantially ninety degrees.

18. A lighting fixture according to claim 16, wherein said second section includes a frangible portion disposed between said first and section segments allowing said second segment to be removed from said first segment.

19. A lighting fixture according to claim 18, further comprising a first staple attaching said first segment of said second section of said first support member to said first support structure; and a second staple attaching said second segment of said second section of said first support member to said first support structure such that each of said first and second securing surfaces abuts a surface of said first support structure.

20. A lighting fixture according to claim 16, further comprising a second support member slidably coupled to said first support member, and having a first section, and a second section substantially perpendicular to said first section of said second support member, said second section of said second support member having first and second segments with first and second securing surfaces, respectively, for adjustably securing said second support member to a second support structure.

21. A lighting fixture according to claim 20, wherein said second section of said second support member includes a frangible portion between said first and second segments of said second support member allowing said second segment of said second support member to be removed from said first segment of said second support member.

22. A lighting fixture, comprising:

a housing having an inner area for holding a socket assembly; and a first support member coupled to said housing, and having a first section and a second section, said second section having a securing surface engaging a first support structure thereby defining a first horizontal angle and a first vertical angle between said first section of said first support member and said first support structure, said first horizontal angle being either one of an obtuse angle and an acute angle, and said first vertical angle being substantially ninety degrees.

23. A lighting fixture according to claim 22, wherein said second section of said first support member is rotatably coupled to said second support member.

24. A lighting fixture according to claim 22, further comprising a second support member coupled to said first support member, and having a first section and a second section, said second section of said second support member having a securing surface engaging a second support structure thereby defining a second horizontal angle and a second vertical angle between said first section of said second support member and said second support structure, said second horizontal angle being either one of an obtuse angle and an acute angle, and said second vertical angle being substantially ninety degrees.

25. A lighting fixture according to claim 24, wherein said housing includes an engagement surface; and said first section of said first support member having a sliding surface engaging said engagement surface of said housing.

26. A lighting fixture, comprising:

a housing including an inner area;

a socket assembly disposed in said inner area of said housing, said socket assembly having a socket and a support bracket attached to said socket, said bracket including upper and lower surfaces;

a first cover releasably coupled to said socket assembly, said first cover having a first cover securing element with opposing first and second surfaces, said second surface abutting said upper surface of said support bracket of said socket assembly; and a first support member coupled to said housing for supporting said housing with respect to a first support structure.

27. A lighting fixture according to claim 26, wherein said support bracket includes a central aperture; and said socket extends through said central aperture.

28. A lighting fixture according to claim 27, wherein said first cover securing element includes a first section attached to said first cover and a second section extending from and substantially perpendicular to said first section; and said first and second surfaces are disposed on said second section.

29. A lighting fixture according to claim 28, wherein said support bracket includes a first notch having a width, said width of said notch being slightly greater than a width of said second section of said first cover securing element.

30. A lighting fixture according to claim 29, wherein said support bracket includes a second notch; and said first cover includes a second trim securing element, said second notch having a width that is slightly larger than a width of said second trim securing element.

31. A lighting fixture, comprising:

a housing having an inner area for holding a socket assembly, and including an engagement surface; and a support member coupled to said housing, and having a first section including a longitudinal axis and a sliding surface directly engaging said engagement surface of said housing thereby supporting said housing on said support member and allowing said housing to slidably traverse said support member along said longitudinal axis, and a second section substantially perpendicular to said first section, and including a vertical axis, and first and second segments, said first and second segments with first and second securing surfaces, respectively, adjustably securing said support member to a support structure with respect to said vertical axis, whereby a horizontal angle and a vertical angle are defined between said first section of said support member and said support structure, said horizontal angle being either one of an obtuse angle and an acute angle, and said vertical angle being substantially ninety degrees.

32. A lighting fixture, comprising:

a housing having an inner area holding a socket assembly therein, and including a first side with a first engagement aperture, and an second side opposing said first side with a second engagement aperture;

a first support member slidably coupled to said housing, said first support member including a first section and a second section substantially perpendicular to said second section, said first section having a sliding surface engaging said first and second engagement apertures of said housing, said second section having first and second segments, each of said first and second segments having first and second securing surfaces, respectively, for securement to a first support structure; and a second support member slidably coupled to said first support member, said second support member including a first section and a second section substantially perpendicular to said second section, said first section having a sliding surface engaging said first support member, said second section having first and second segments, each of said first and second segments having first and second securing surfaces, respectively, for securement to a second support structure, whereby said housing can slidably traverse said first and second support members along said sliding surface.

33. A lighting fixture according to claim 32, further comprising a first cover having first and second cover securing elements; and said socket assembly having a support bracket, said first and second cover securing elements releasably engaging said support bracket of said socket assembly.

34. A lighting fixture according to claim 33, further comprising:

a second cover member having opposing first and second openings, and a plurality of cover securing elements, said first opening receiving said housing with said securing elements being releasably engaged with said first and second sides of said housing, and said second opening being substantially larger than said first opening and providing access to said housing.

35. A lighting fixture according to claim 34, wherein said socket assembly includes a socket with a lamp connected thereto.

36. A lighting fixture according to claim 34, wherein said first segment of said first support member is attached to said first support structure; and said first segment of said second support member is attached to said second support structure.

37. A lighting fixture according to claim 36, wherein said second segment of said first support member is attached to said first support structure; and said second segment of said second support member is attached to said second support structure.

38. A lighting fixture according to claim 37, wherein said first and second sections of said first support member are rotatably coupled, said first section forming a first horizontal angle and a first vertical angle with said first support structure, said first horizontal angle is either one of an obtuse angle and an acute angle, and said first vertical angle is substantially ninety degrees; and said first and second sections of said second support member are rotatably coupled, said first section forming a second horizontal angle and a second vertical angle with said second support structure, said second horizontal angle is either one of an obtuse angle and an acute angle, and second first vertical angle is substantially ninety degrees.

39. A lighting fixture according to claim 37, wherein said first section of said first support member is substantially perpendicular to said first support structure; and said first section of said second support member is substantially perpendicular to said second support structure.

40. A lighting fixture according to claim 37, wherein said first support member includes a frangible portion between said first and second segments of said first support member allowing said second segment to be removed from said first segment of said first support member; and said second support member includes a frangible portion between said first and second segments of said second support member allowing said second segment to be removed from said first segment of said second support member.

41. A lighting fixture according to claim 40, wherein said socket assembly being electrically connected to a junction box.

42. A lighting fixture according to claim 41, wherein each of said first and second support members are substantially U-shaped in cross-section.

43. A lighting fixture, comprising:

a housing having an inner area for holding a socket assembly, and including an engagement surface, said housing includes an outer surface with an extension portion disposed thereon;

a slot being defined between said outer surface and said extension portion with said engagement surface being located on either one of said extension portion and said outer surface; and a first support member coupled to said housing, and having a longitudinal axis, and first and second sections, said first section having a sliding surface for engaging said housing, said second section having a first securing surface for engaging a first support structure, and said sliding surface of said first section engaging said engagement surface of said housing, thereby supporting said housing on said first support member and allowing said housing to slidably traverse said first support member along said longitudinal axis.

* * * * *